US009386889B2

(12) United States Patent
Fischer

(10) Patent No.: US 9,386,889 B2
(45) Date of Patent: Jul. 12, 2016

(54) PERSONAL CLEANING SYSTEM

(75) Inventor: Seira Fischer, Hamburg (DE)

(73) Assignee: Seira Fischer, Hamburg (DE)

( * ) Notice: Subject to any disclaimer, the term of this patent is extended or adjusted under 35 U.S.C. 154(b) by 180 days.

(21) Appl. No.: 13/976,488

(22) PCT Filed: Dec. 28, 2011

(86) PCT No.: PCT/DE2011/002189

§ 371 (c)(1),
(2), (4) Date: Jun. 27, 2013

(87) PCT Pub. No.: WO2012/097778

PCT Pub. Date: Jul. 26, 2012

(65) Prior Publication Data

US 2013/0283516 A1 Oct. 31, 2013

(30) Foreign Application Priority Data

Dec. 29, 2010 (DE) ..... 20 2010 013 232 U

(51) Int. Cl.
*A47K 7/04* (2006.01)
*A47K 3/28* (2006.01)
*A47K 10/48* (2006.01)

(52) U.S. Cl.
CPC ... *A47K 7/04* (2013.01); *A47K 3/28* (2013.01); *A47K 10/48* (2013.01)

(58) Field of Classification Search
CPC ..... A47K 3/286; A47K 3/287; A47K 7/04; B05B 1/185
USPC ..... 4/535–537, 615, 597, 601; 134/72, 131
See application file for complete search history.

(56) References Cited

U.S. PATENT DOCUMENTS 3,483,572 A * 12/1969 Hallum ..... 4/597
3,668,710 A * 6/1972 Dowd ..... 4/597
4,348,777 A 9/1982 Peterson (Continued)

FOREIGN PATENT DOCUMENTS

DE 12 91 482 B 3/1969
DE 40 07 740 A1 9/1991

(Continued)

OTHER PUBLICATIONS

International Search Report and Written Opinion of the International Searching Authority dated Sep. 27, 2013 issued in the corresponding International patent application No. PCT/DE2011/002189 (English translation only).

(Continued)

*Primary Examiner* — Janie Loeppke
(74) *Attorney, Agent, or Firm* — Posz Law Group, PLC

(57) ABSTRACT

A cleaning system according to the invention includes a scanning unit for determining body dimensions, for example, the girth measurements such as height and breadth of the person to be cleaned, at least two moldings having a body-size opening, wherein the opening corresponds to a pose, that is, a body position of the person to be cleaned, a conveying unit that conveys the person to be cleaned through the moldings, wherein at least one of the moldings contains adjustable spray nozzles, the spacing of which from the person to be cleaned is adjusted corresponding to the body dimensions of the person to be cleaned determined by the scanning unit.

19 Claims, 3 Drawing Sheets

(56) References Cited

U.S. PATENT DOCUMENTS

| | | | | |
|---|---|---|---|---|
| 5,099,587 | A * | 3/1992 | Jarosch | 34/202 |
| 5,335,378 | A | 8/1994 | Chiang | |
| 5,853,130 | A * | 12/1998 | Ellsworth | 239/548 |
| 6,302,122 | B1 | 10/2001 | Parker et al. | |
| 2002/0096186 | A1 | 7/2002 | Von Halem | |
| 2005/0172396 | A1 * | 8/2005 | Marrs | A47K 3/286 4/615 |
| 2006/0064815 | A1 * | 3/2006 | Guerin et al. | 4/596 |
| 2009/0293190 | A1 * | 12/2009 | Ringelstetter et al. | 4/605 |

FOREIGN PATENT DOCUMENTS

| | | | |
|---|---|---|---|
| DE | 8916098 | U1 | 8/1993 |
| DE | 4325971 | C1 | 2/1995 |
| DE | 19721373 | A1 | 11/1998 |
| GB | 446 763 | A | 5/1936 |
| JP | 3-106806 | | 5/1993 |
| JP | 06-296903 | A | 10/1994 |
| JP | 10-089740 | A | 4/1998 |
| JP | 2006-101914 | A | 4/2006 |
| WO | 2004/069322 | A1 | 8/2004 |

OTHER PUBLICATIONS

International Preliminary Report on Patentability of the International Searching Authority dated Nov. 12, 2013 issued in the corresponding International patent application No. PCT/DE2011/002189 (English translation only).

Office action issued Oct. 6, 2015 in the corresponding JP application No. 2013-546588 (with English translation attached).

Chinese Office Action issued on Jun. 16, 2015 in the corresponding CN patent application No. 201180063725.X (Partial translation attached).

Office Action issued Dec. 31, 2015 in the corresponding CN application No. 201180063725.X (with English translation).

* cited by examiner

PERSONAL CLEANING SYSTEM

CROSS-REFERENCE TO RELATED APPLICATIONS

This application is a U.S. national stage application of International Application No. PCT/DE2011/002189 filed on Dec. 28, 2011, and claims priority to, and incorporates by reference, German Patent Application No. 20 2010 013 232.0 filed on Dec. 29, 2010.

BACKGROUND

The invention relates to a device for cleaning a human body.

It is known that shower systems are used for cleaning and/or washing the human body. Such shower systems, which are mostly installed for stationary use, may comprise, for example, fixedly installed spray nozzles or else removable shower heads in order to enable all parts of the body to be cleaned. DE 43 25 971 C1, for example, discloses a device for cleaning a human body, having a multiplicity of water spray nozzles, cleaning agent spray nozzles and airstream nozzles, wherein all the nozzles are arranged in a manner adhering to a minimum distance from the body to be cleaned. At the beginning of a washing operation, the body to be cleaned is wetted with water from the water spray nozzles, and subsequently a soap emulsion, for example, is added from the cleaning agent spray nozzles as a cleaning agent. The body which has been wetted with cleaning agent in this manner is subsequently freed of said cleaning agent by water which in turn exits from the water spray nozzles for rinsing off the cleaning agent. Warm air for drying the body exits from the airstream nozzles. The spray water and the soap emulsion may expediently both be temperature controlled. The device may moreover have a control device which adjusts the nozzles to a predetermined minimum distance from the human body to be cleaned according to the size of the human being to be cleaned which has been detected by sensors.

Documents U.S. Pat. No. 6,302,122 B1, WO 2004/069322 A1, US 2002/0096186 A1 and DE 197 21 373 A1 disclose cubicles in which, for example, a bather is covered with a mist of sun screen agents or other personal care products by adjustable spray nozzles. These cubicles, too, may comprise a device for adapting the spray nozzles to the body size of the user in each case. After the application of the sun screen or care agents, the user may then independently distribute and rub them in.

The German utility model G 89 16 098 refers to a movable warm air dryer for drying the human body in situations prevailing with certain illnesses in which the human skin must not be dried using conventional towels. The device may also be deployed for the warm/hot-air or cold-air treatment of rheumatic ailments. The movable warm air dryer comprises a hot air generator for heating and distributing the air, an integrated container for volatile substances, and at least one warm air duct with a multiplicity of flexible, rotatable and adjustable nozzles, and a control unit for controlling the intensity of the air and heat according to the selected application.

It is a common feature of all the aforementioned devices that only a single person can in each case use the shower, drying or lotion cubicle for the entire cleaning and/or application process. Even when, for example, only the water nozzles in the shower cubicle are being used, another person cannot simultaneously use the drying nozzles, as the latter are located in the same cubicle as the spray nozzles.

JP 10-89740 discloses another device for generating an airstream around a human body in the entry region of a clean room. In order to remove dust and adhering dirt from the clothing of a person entering, according to JP 10-89740 the entry region has a treadmill which moves roughly at the walking speed of the person entering, but in the opposite direction of the person entering, such that the forward movement of the person entering is roughly compensated and that an airstream coming from above can blow away dust and dirt particles from the clothing of the person entering.

U.S. Pat. No. 3,483,572 discloses an automated bathing device for washing and drying a large number of patients or persons in an upright position from above, having a support frame for support and conveyance. In all known cleaning devices, the person to be cleaned can also freely move in such a manner that they can escape the required cleaning process by adopting a corresponding position.

The invention is thus based, for example, on an object of providing a personal cleaning system which ensures the cleaning of predetermined body parts of the person to be cleaned.

To achieve this object, a personal cleaning system having the features of claim 1 is proposed. The features of advantageous developments are respectively recited in the dependent claims.

SUMMARY

The personal cleaning system according to the invention comprises a scanning unit for determining the body dimensions, for example the size measurements such as height and width of the person to be cleaned, at least two shaped elements having a body-sized opening, the opening corresponding to a pose, that is to say a body position, of the person to be cleaned, a conveying unit which conveys the persons to be cleaned through the shaped elements, wherein at least one of the shaped elements contains adjustable spray nozzles, the distance of which from the person to be cleaned is adjusted according to the body dimensions of the person to be cleaned which have been determined by the scanning unit.

According to an advantageous embodiment, the scanning unit is located at the first shaped element when viewed in the conveying direction.

According to a further advantageous embodiment, the entire personal cleaning system is located inside a container. The container in this case may be a transportable shipping container.

According to a further advantageous embodiment, an escape door is located between the respective shaped elements of the personal cleaning system located inside the container.

According to a further advantageous embodiment, the spray nozzles are located such that a complete wetting of the person to be cleaned is ensured.

According to a further advantageous embodiment, at least one of the shaped elements of the personal cleaning system contains foam rollers.

According to a further advantageous embodiment, at least one of the shaped elements of the personal cleaning system contains air nozzles, for example for drying or warming the person cleaned.

According to a further advantageous embodiment, the personal cleaning system comprises a heating device for heating the air which is dispensed through the air nozzles.

According to a further advantageous embodiment, the personal cleaning system comprises a unit for distributing fragrances.

A further advantageous embodiment has a control device for selecting a particular soap and/or a particular fragrance.

The personal cleaning system according to the invention may, for example, find an application as an adventure shower, as a promotional product (for example in the cosmetics industry, the sports sector, etc.) or else when fixedly installed in leisure parks. The personal cleaning system may also find an application for cleaning and/or amusement at festivals and events or fairs. Beyond this, the personal cleaning system according to the present invention may be used as a cleaning system in swimming baths, water parks or, adapted with different nozzles for revitalization and relaxation, also in the spa sector. Accordingly, and depending on the application, the person may be cleaned when nude, wearing swimwear or, for example, also wearing fast-drying microfiber garments. A further application could, for example, be an art installation in which, for example, not water but paint is sprayed from the nozzles. But the personal cleaning system according to the present invention could also be deployed as a mobile shower device, for example by disaster relief organizations, the Red Cross or the armed forces, for example using a self-contained, self-cleaning water circulation system, for alleviating the spread of diseases in, for example, crisis areas and refugee camps. Using, chemical additives for example, a personal cleaning system according to the invention could also find an application at airports or hospitals, for example, for the decontamination of victims of contamination.

BRIEF DESCRIPTION OF THE DRAWINGS

In the following, exemplary embodiments of the invention are explained in more detail with reference to the figures, in which.

DETAILED DESCRIPTION

Figure 1:
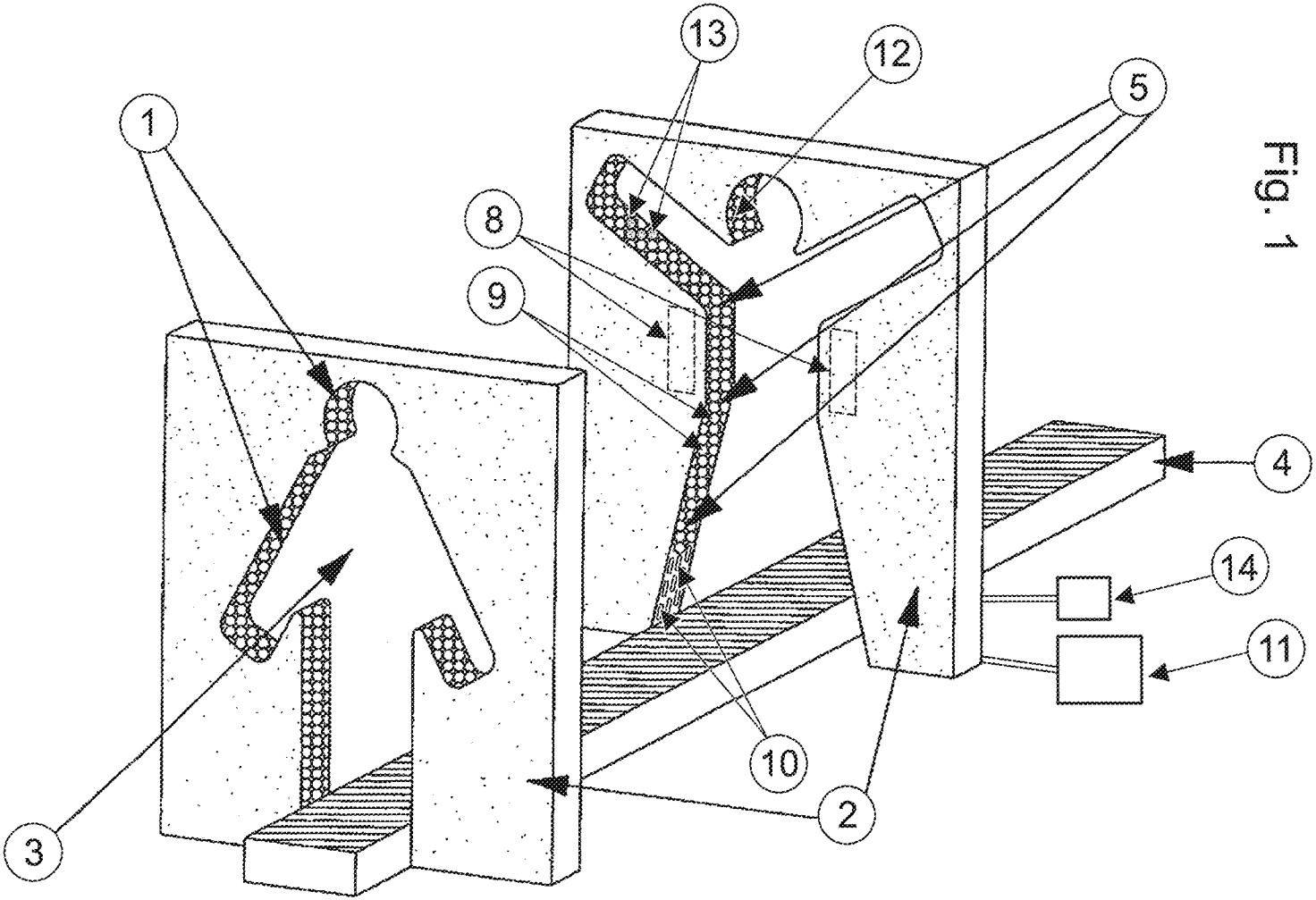
FIG. 1 shows a perspective view of an exemplary embodiment of a personal cleaning system according to the invention.

A perspective view of an example of an embodiment of the present invention is illustrated in FIG. 1. By way of example, in FIG. 1 a scanning unit 1 is located in the first shaped element 2 of the personal cleaning system. The purpose of the scanning unit is to determine the body dimensions of the person to be cleaned. To this end, the scanning device may, for example, determine the size of the human body in the directions of length, width and depth, for example by means of laser radiation which, for example, is emitted from one side and/or above, for example by laser diodes, and detected on the opposite side of the laser diodes by means of light-sensitive detectors. The scanning unit for detecting the body dimensions of the person to be cleaned need not, however, be located in a shaped element 1 as illustrated in FIG. 1, but may also be arranged as a separate unit independently of the shaped element, for example as a first element when entering the personal cleaning system. Other types of detectors, such as, for example, contact-sensitive detectors having tactile sensors may also be used to determine the body dimensions of the person to be cleaned. The personal cleaning system according to the present invention moreover comprises a conveying unit 4, onto which the person to be cleaned steps and is thus conveyed through the cleaning system. In this case, the conveying unit 4, may be formed as a conveyor belt, for example made of rubber or using metal ribbed elements, as deployed, for example, at airports. The conveying unit is advantageously driven by a drive unit, for example an electric motor or an internal combustion engine. Depending on the field of application, the power required may be generated on site by means of, for example, solar power, for example in countries without their own power supply. For this purpose, the personal cleaning system according to the present invention may have its own solar power plant with solar cells and energy storage in the form of batteries. The conveying unit may also be constructed from individual plastic segments as in, for example, a baggage carousel at airports, and have, for example, a length of two to thirteen meters, a width of 50 cm to 100 cm, and a height of 10 to 50 cm. The personal cleaning system according to the present invention moreover has at least two shaped elements 2, which each contain one body-sized opening 3, the opening 3 corresponding to a pose (body position) of the person to be cleaned. The shaped elements 2 may be formed from materials that can be shaped, such as, for example, stone, insulation boards, wood, plastic, cardboard, foamed materials, polystyrene foam, or combinations thereof. According to the present invention, the shaped elements 2 are formed such that the person to be cleaned is conveyed by the conveyor belt through the at least two shaped elements and/or their body-sized openings, in the course of which the person to be cleaned has to assume different poses in the case of different shaped elements (see, for example, FIGS. 3*a* to 3*f*), and, for example, different cleaning steps, such as, for example, wetting with water, lathering, scrubbing, massaging, drying, application of fragrances, etc., have to be carried out at the respective shaped elements. The shaped elements 2 advantageously have a height of 200 cm to 300 cm, a width of 200 cm to 300 cm and a depth of 20 cm to 50 cm. The personal cleaning system according to the present invention advantageously has four to six of such shaped elements 2. The scanning unit 1 for determining the body dimensions of the person to be cleaned may, for example, be located on or in the first shaped element 2. Spray nozzles 5 for applying water, soap or foam may be located in the second shaped element, the body-sized opening 3 of which corresponds, for example, to a different pose than the body-sized opening of the first shaped element. A further shaped element could then have means for lathering the person to be cleaned. In this arrangement, the foam may, for example, be sprayed from nozzles or, for example, be applied to the person to be cleaned by means of foam rollers 8. According to a preferred embodiment, each opening of the shaped element containing foam rollers 8 contains, to the left and right of the person to be cleaned in the direction of the conveyor belt, on each side two foam rollers 8 which extend out from both sides of the shaped element and move across in front of the body of the person to be cleaned and back again, and along the side to the rear of the person. In this manner, a complete wetting of the body with soap is achieved, in which advantageously only the face is omitted.

Water nozzles which rinse the foam from the person to be cleaned may be advantageously located in a subsequent shaped element. In subsequent shaped elements, air nozzles 9, for example, may then be located as drying nozzles, through which warm air is advantageously dispensed onto the person to be cleaned. The air nozzles 9 may, for example, be of a slot-like form, such that, for example, purified and heated air at high pressure and high speed dries the body, including any optionally worn microfiber garments. Advantageously, all the nozzles 5 or also the scanning unit 1 may be located at and/or integrated in the shaped element 2 in such a manner that they do not protrude beyond the contour of the shaped element. As a result of this arrangement, any injury to the person to be cleaned arising from contact with the nozzles 5 or the scanning unit 1 can be prevented.

According to an advantageous embodiment of the present invention, the last shaped element in the running direction of the conveying unit 4 may, for example, contain nozzles 12 through which fragrances, for example deodorant or similar, are dispensed onto the person to be cleaned. The fragrances are advantageously sprayed from four fragrance diffuser nozzles 13.

According to an advantageous embodiment of the invention, the personal cleaning system has a control device 14 with which the person to be cleaned can select, for example, the soap and the fragrances from a multiplicity of soaps and fragrances on offer. The water and drying air temperature could also be advantageously adjusted by said control device 14. FIGS. 3*a* to 3*f* show by way of example different shaped elements having body-sized openings of different designs. As may be derived from FIGS. 3*a* to 3*f*, the body-sized opening in each case corresponds to a pose and/or a body position of the person to be cleaned. Advantageously, the different shaped elements of the personal cleaning system according to the invention have different body-sized openings and/or correspondingly different poses. For example, an opening 3 according to FIG. 3*e*) could correspond to a "drying pose", according to FIG. 3*c*) to a "lathering pose" or according to FIG. 3*f*) to a "finishing pose". The openings of the shaped elements corresponding to a corresponding position may force the person to be cleaned to adopt a specific position such that, using correspondingly located spray, wash or foam nozzles, indeed any desired part of the body can be reliably cleaned. Different poses of the person to be cleaned may, however, also be used for the purpose of entertainment at festivals. For example, the last shaped element could represent a victory pose.

As shown in the exemplary embodiment in FIG. 1, the spray nozzles 5 may, therefore, also be located, for example, between the legs and/or below the armpits of the person to be cleaned. The spray nozzles 5 of the personal cleaning system according to the invention are adjustably designed, such that the spray nozzles can be adjusted according to the body dimensions of the person to be cleaned determined by the scanning unit. As a result of this adjustment possibility, reliable cleaning without injury to the person to be cleaned can be ensured. The adjustable spray nozzles may, for example, be adjusted individually or collectively in groups, for example by motorized linear drives, to within a certain distance from the body of the person to be cleaned which corresponds to the body dimensions of the person to be cleaned. The number of spray nozzles may advantageously be between 3 and 30. For example, 15 nozzles wetting a wide area and spaced at a distance of, for example, 30 cm along the opening in the shaped element and at salient positions to be cleaned, such as the armpits, hips, crotch, are particularly advantageous. In order to hygienically clean a wide area, the spray nozzles may advantageously be designed in such a manner that their spraying angle can be varied.

Figure 2:
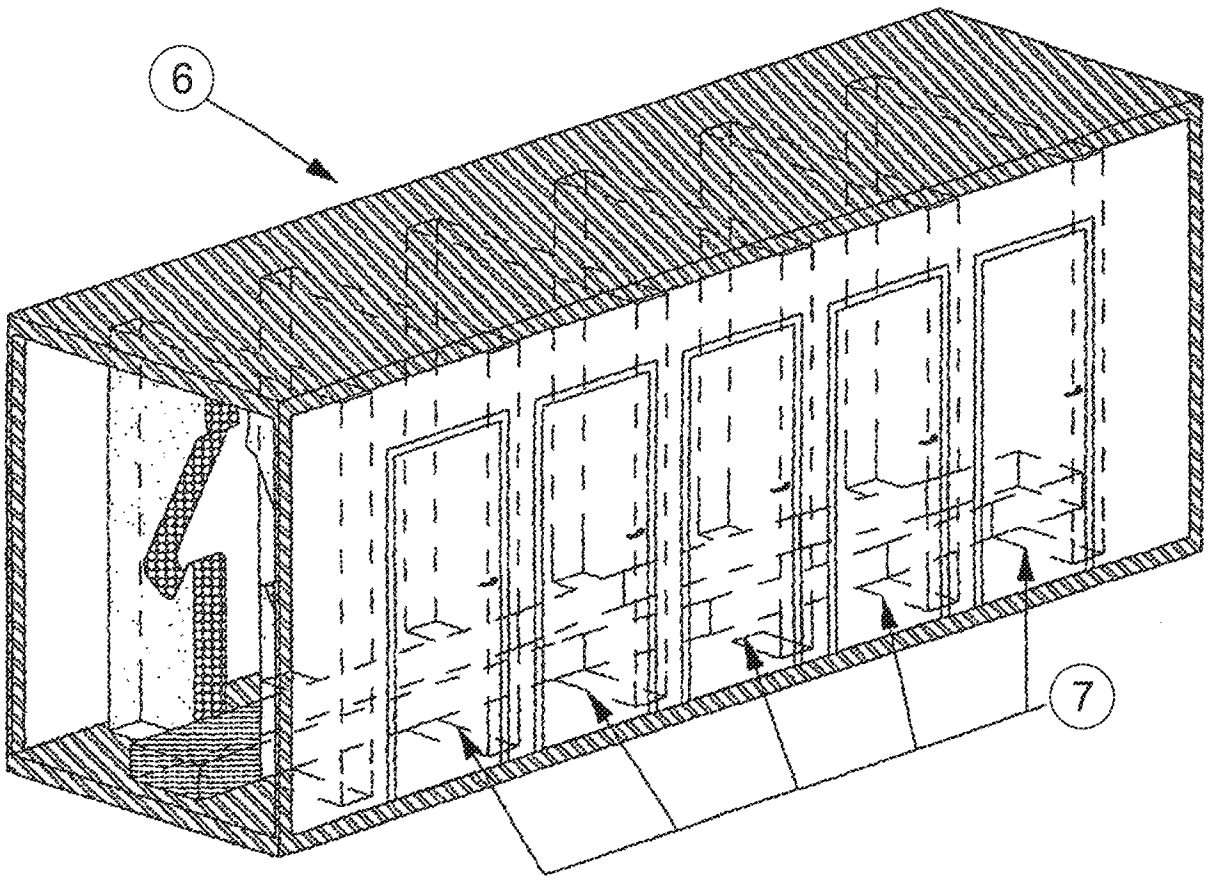
FIG. 2 shows a schematic drawing of a personal cleaning system according to the present invention which is located inside a shipping container, FIGS. 3*a*) to 3*f*) show exemplary embodiments of shaped elements having differently formed body-sized openings.
Figure 3:
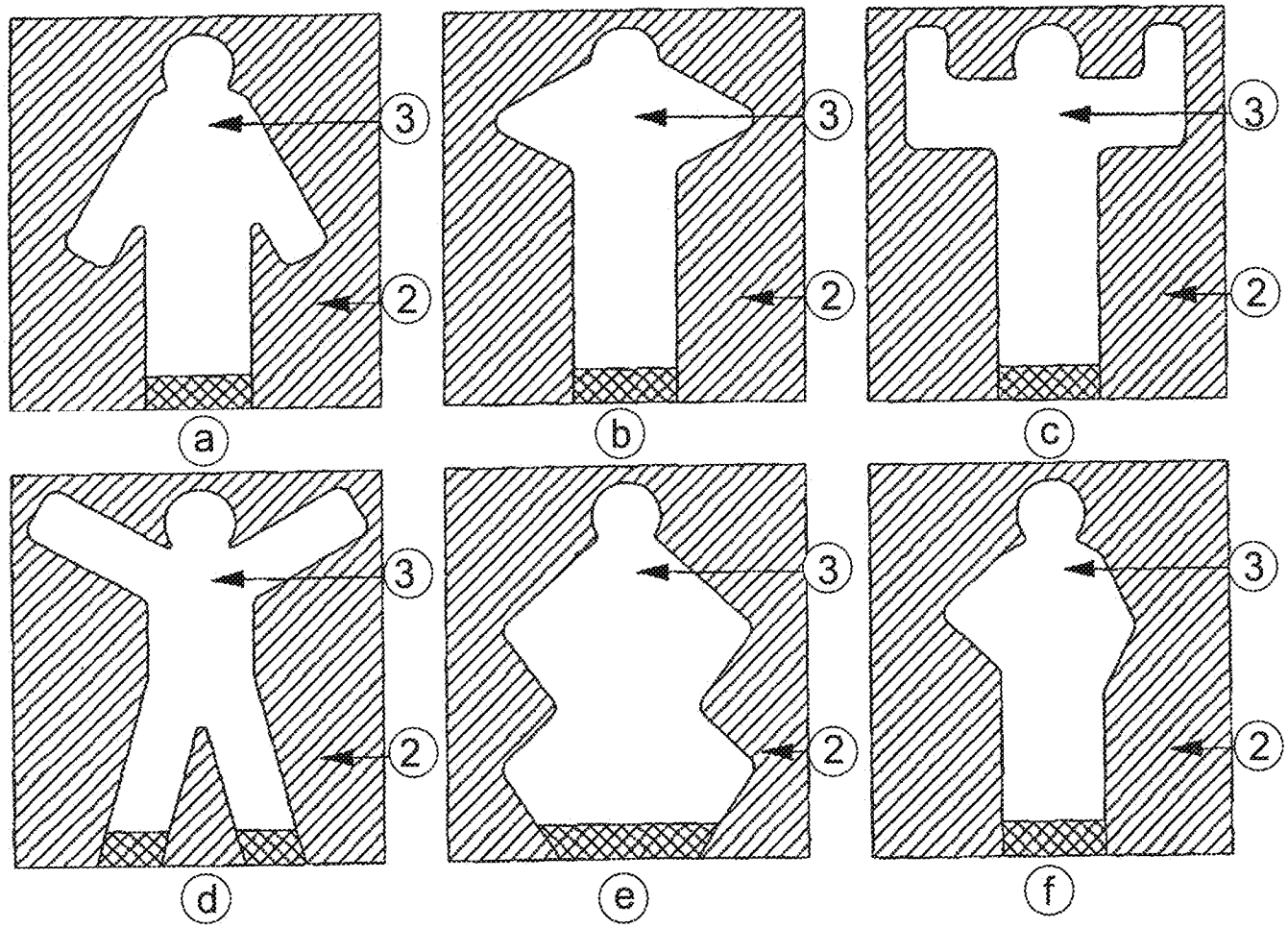

In order to enable the personal cleaning system to be transportable, for example from one event to another, or else to enable it also to be used in crisis areas, the personal cleaning system according to the present invention may also be located inside a container 6, as illustrated in FIG. 2. The container 6 may, for example, be a standard shipping container of, for example, 20 feet size (length 6.095 m, width 2.352 m, height 2.393 m) or 40 feet size (length 12.032 m, width 2.352 m, height 2.393 m). Therefore, particularly advantageous dimensions of the shaped elements 2 are, in the case of arrangement inside a container 6, a height of 210 cm, a width of 227 cm and a depth of 20 cm. Other containers, such as, for example, trailers or accommodation containers, such as are used, for example, on construction sites, are also possible.

To ensure optimum safety, escape doors 7 may be located between the individual shaped elements 2 of a personal cleaning system located inside a container 6. The container 6 may also contain openings or windows or else be made completely transparent, for example for events.

According to a further advantageous embodiment, the personal cleaning system according to the invention may be equipped with a heating device 11, which either, for example, by means of a heating blower heats the chamber of the personal cleaning system and/or heats the air which is blown through the air nozzles 9 of, for example, a shaped element. In this manner, an agreeable temperature for the cleaning process can, for example, also be adjusted inside the container 6. Similar to an air lock in a department store during winter, the heating blower may, however, also generate an agreeable temperature for cleaning a body in the case of a personal cleaning system according to the present invention which is set up in the open, that is to say a system which is not located inside a container 6.

Instead of air nozzles 9 for drying the person to be cleaned, the personal cleaning system of the present invention may, for example, also have suspended drying webs made from absorbent material, such as, for example, microfiber cloths, sponge materials, cotton materials or similar. Massage units, such as, for instance, rubber rollers, may also be located in the shaped elements for the purpose of, for example, stimulating the blood circulation in the cleaned body.

The personal cleaning system according to the present invention may, for example, be of modular construction such that individual modules, for example a massaging module or a drying module, may be added to an already existing personal cleaning system at a later date.

The invention claimed is:

1. A personal cleaning system comprising a scanning unit for determining body dimensions of a person to be cleaned, wherein the body dimensions are at least a height and a width of the person to be cleaned, at least two shaped elements having a body-sized opening, the opening corresponding to a pose of the person to be cleaned, a conveying unit, which conveys the person to be cleaned through the shaped elements, adjustable spray nozzles for applying water, soap or foam, and a drive unit to adjust the spray nozzles corresponding to the body dimensions of the person to be cleaned detected by the scanning unit, wherein at least one of the shaped elements contains the adjustable spray nozzles, the distance of which from the person to be cleaned is adjusted according to the body dimensions of the person to be cleaned, which have been determined by the scanning unit.

2. The personal cleaning system as claimed in claim 1, wherein the scanning unit is located at the first shaped element.

3. The personal cleaning system as claimed in claim 2, wherein the entire personal cleaning system is located inside a container.

4. The personal cleaning system as claimed in claim 2, wherein the spray nozzles are located such that a complete wetting of the person to be cleaned is ensured.

5. The personal cleaning system as claimed in claim 1, wherein the entire personal cleaning system is located inside a container.

6. The personal cleaning system as claimed in claim 5, wherein an escape door is located between the respective shaped elements inside the container.

7. The personal cleaning system as claimed in claim 1, wherein the spray nozzles are located such that a complete wetting of the person to be cleaned is ensured.

8. The personal cleaning system as claimed in claim 7, wherein the spray nozzles are configured such that their spraying angle is variably adjustable.

9. The personal cleaning system as claimed in claim 1, wherein at least one shaped element contains foam rollers.

10. The personal cleaning system as claimed in claim 9, wherein each opening of the shaped element containing foam rollers, said opening being located to the left and right of the person to be cleaned in the direction of the conveyor belt, contains two foam rollers.

11. The personal cleaning system as claimed in claim 1, wherein at least one shaped element contains air nozzles.

12. The personal cleaning system as claimed in claim 11, having a heating device for heating the air for the air nozzles.

13. The personal cleaning system as claimed in claim 1, having a unit for distributing fragrances.

14. The personal cleaning system as claimed in claim 13, wherein the unit for distributing fragrances consists of four fragrance diffuser nozzles.

15. The personal cleaning system as claimed in claim 1, having a control device for selecting a particular soap and/or a particular fragrance.

16. The personal cleaning system as claimed in claim 1, wherein the openings of the at least two shaped elements correspond to different poses of the person to be cleaned.

17. The personal cleaning system as claimed in claim 1, wherein the scanning unit comprises a laser radiation and detection unit and/or a contact-sensitive sensor unit.

18. The personal cleaning system as claimed in claim 1, wherein the nozzles and/or the scanning unit are located at and/or integrated in the at least two shaped elements in such a manner that they do not protrude beyond the contour of the at least two shaped elements.

19. The personal cleaning system as claimed in claim 1, wherein the personal cleaning system is of modular construction such that individual modules are added to an already existing personal cleaning system at a later date.

* * * * *